US009692141B2

(12) United States Patent
Orban et al.

(10) Patent No.: US 9,692,141 B2
(45) Date of Patent: Jun. 27, 2017

(54) ANTENNA ARRAY OF INVERTED-L ELEMENTS OPTIONALLY FOR USE AS A BASE STATION ANTENNA

(71) Applicant: ORBAN MICROWAVE PRODUCTS NV, Wijgmaal (BE)

(72) Inventors: Daniel Orban, Leuven (BE); Gerald Moernaut, Leuven (BE)

(73) Assignee: ORBAN MICROWAVE PRODUCTS NV, Wijgmaal (BE)

( * ) Notice: Subject to any disclaimer, the term of this patent is extended or adjusted under 35 U.S.C. 154(b) by 71 days.

(21) Appl. No.: 14/454,199

(22) Filed: Aug. 7, 2014

(65) Prior Publication Data

US 2015/0042535 A1 Feb. 12, 2015

(30) Foreign Application Priority Data

Aug. 9, 2013 (GB) ..... 1314293.0

(51) Int. Cl.

| | |
|---|---|
| ***H01Q 21/26*** | (2006.01) |
| ***H01Q 21/22*** | (2006.01) |
| ***H01Q 1/24*** | (2006.01) |
| ***H01Q 9/42*** | (2006.01) |
| ***H01Q 21/24*** | (2006.01) |

(Continued)

(52) U.S. Cl.

CPC ..... *H01Q 21/22* (2013.01); *H01Q 1/246* (2013.01); *H01Q 1/38* (2013.01); *H01Q 1/526* (2013.01); *H01Q 5/371* (2015.01); *H01Q 9/42* (2013.01); *H01Q 19/10* (2013.01); *H01Q 21/20* (2013.01); *H01Q 21/205* (2013.01); *H01Q 21/24* (2013.01); *H01Q 21/26* (2013.01); *H01Q 21/30* (2013.01)

(58) Field of Classification Search

CPC ..... H01Q 21/24; H01Q 9/42
USPC ..... 343/797
See application file for complete search history.

(56) References Cited

U.S. PATENT DOCUMENTS 6,140,972 A 10/2000 Johnston et al.
6,356,242 B1 * 3/2002 Ploussios ..... H01Q 9/42 343/795

(Continued)

FOREIGN PATENT DOCUMENTS

CN 2836258 Y 11/2006
CN 201741802 U 2/2011

(Continued)

OTHER PUBLICATIONS

European Search Report dated Dec. 23, 2014, for EP 14180533.3.
GB Search Report dated Oct. 28, 2013, for GB 1314293.0.

*Primary Examiner* — Graham Smith
(74) *Attorney, Agent, or Firm* — Bacon & Thomas, PLLC

(57) ABSTRACT

An antenna for receiving and/or transmitting electromagnetic radiation, e.g. circularly polarized waves. The antenna is built of three parts. A radiating element in the form of a sequentially rotated array of 4 dual inverted-L shaped surfaces, where each individual radiating element is fed with the same magnitude and a 90° sequential phase difference for the purpose of creating right or left hand circular polarization. A ground plane. And optionally, a structure that resembles a dual so-called choke ring structure on which the array is mounted. This structure improves the axial ratio and radiating pattern of the radiating elements and also serves as housing/shielding of the accompanying electronics like low noise amplifiers and power conditioning.

17 Claims, 10 Drawing Sheets

(51) Int. Cl.

| | |
|---|---|
| ***H01Q 1/38*** | (2006.01) |
| ***H01Q 19/10*** | (2006.01) |
| ***H01Q 21/20*** | (2006.01) |
| ***H01Q 5/371*** | (2015.01) |
| ***H01Q 1/52*** | (2006.01) |
| ***H01Q 21/30*** | (2006.01) |

(56) References Cited

U.S. PATENT DOCUMENTS

| | | | |
|---|---|---|---|
| 6,618,016 | B1 | 9/2003 | Hannan et al. |
| 6,819,291 | B1 | 11/2004 | Lackey et al. |
| 7,450,082 | B1 | 11/2008 | Lopez |
| 2006/0145926 | A1 | 7/2006 | Choi et al. |
| 2007/0236400 | A1 | 10/2007 | Rentz |
| 2010/0164831 | A1 | 7/2010 | Rentz et al. |
| 2012/0299789 | A1 | 11/2012 | Orban et al. |

FOREIGN PATENT DOCUMENTS

| | | | |
|---|---|---|---|
| CN | 102013549 | A | 4/2011 |
| CN | 202585719 | U | 12/2012 |
| DE | 102011007786 | A1 | 10/2012 |
| JP | 2011003984 | A | 1/2011 |
| WO | 01/76012 | A1 | 10/2001 |

* cited by examiner

ANTENNA ARRAY OF INVERTED-L ELEMENTS OPTIONALLY FOR USE AS A BASE STATION ANTENNA

FIELD OF INVENTION

The application relates to an antenna for receiving and/or transmitting electromagnetic radiation, e.g. circularly polarized waves, e.g. for use as a base station antenna as well as a method manufacturing and operating the same.

BACKGROUND

Different approaches for an antenna with circularly polarized electromagnetic waves having a hemispherical radiation pattern exist. In particular, the global positioning system (GPS) is a global navigation satellite system, which necessitates the use of optimized antennas. GPS satellites broadcast radio signals to enable GPS receivers to determine location and synchronized time. GPS signals include ranging signals, used to measure the distance to the satellite, and navigation messages. The navigation messages include data, used to calculate the position of the satellite in orbit, and information about the time and status of the entire satellite constellation, called the almanac. This information is modulated onto an electromagnetic signal having a predetermined polarization. These antennas have particular requirements that must be met.

For example, a relatively high transmission bandwidth is desirable, such that the antenna can be operated across a large frequency range. Next, the radiation pattern of the antenna should preferably be hemispherical such that signals are received from as many satellites as possible. Finally, a good circular polarization is required across the bandwidth of the antenna. However, other applications for such an antenna are also possible.

US2012299789 describes an antenna for transmitting and/or receiving-electromagnetic waves having a flat ground plane, and an array of radiating and/or receiving elements. The radiating and/or receiving element comprises a planar conductor which is arranged in parallel to the ground plane. L-shaped slots are arranged in the planar conductor. US2012299789 is included by reference into the present application.

SUMMARY OF THE INVENTION

The present invention provides an antenna for receiving and/or transmitting electromagnetic radiation, e.g. circularly polarized waves, comprising four radiating elements in the form of a sequentially rotated array of 4 inverted-L-shaped surfaces extending away from a ground plane, each inverted-L-shaped surface comprising a leg and an arm, the legs extending away from the ground plane and having a bend to form the arms which extend parallel to the ground plane towards the center of the ground plane, the leg and arm of each inverted-L-shaped surface lying in the same plane which extends away from the ground plane.

Antennas according to embodiments of the present invention can be used as a base station antenna.

An advantage of embodiments of the present invention is that the antenna can transmit and/or receive, e.g. circularly polarized waves, across a large frequency range and preferably with a hemispheric radiation pattern and good axial ratio. Another advantage of embodiments of the present invention is that the antenna can transmit and/or receive, e.g. circularly polarized waves, at different frequency ranges and preferably with a hemispheric radiation pattern and good axial ratio. The antenna can be used as a base station antenna. A hemispheric radiation pattern radiates and receives as uniformly as possible over the hemisphere which is in contrast to a beam-forming pattern which will concentrate that radiation pattern along a narrow beam.

The present invention provides axially symmetric antennas having a radiation pattern that is hemispherical or substantially hemispherical. They can radiate and receive in all directions on one side of a ground plane, e.g. they can radiate and receive in all directions electromagnetic power on one side or mainly on one side of a ground plane. Antennas according to embodiments of the present invention are particularly for use with multiple sources such as multiple satellite transmitters and receivers and hence require a uniform radiation and reception pattern in one hemisphere above a ground plane with some rejection of unwanted signals from below the ground plane. The antennas of embodiments of the present invention are preferably designed to operate effectively with two frequency bands.

The antenna can be built of two parts:

An array of Radiating Elements which is a sequentially rotated array of 4 or more dual inverted-L shaped conductive surfaces. Each individual radiating element is fed with the same magnitude and a 90° sequential phase difference with respect to its neighboring element for the purpose of creating right or left hand circular polarization, and A ground plane.

The antenna is optionally a cavity backed antenna. The antenna optionally includes a structure that resembles a dual so-called choke ring structure on which the radiating element is mounted. This structure improves the axial ratio and radiation pattern of the radiating element and also can serve as housing/shielding of the accompanying electronics like low noise amplifiers and power conditioning.

The four dual inverted-L shaped conductive surfaces are sequentially fed with a 90° phase difference, e.g. radiating element 1: 0°, radiating element 2: −90°, radiating element 3: −180° and radiating element 4: −270°. The four dual inverted-L shaped conductive surfaces elements are the sole, and thus main, radiators or receivers. Each inverted L element radiates like a bent monopole.

The antenna may include two sets of four dual inverted-L shaped conductive surfaces. Each set is sequentially fed with a 90° phase difference, e.g. radiating element 1: 0°, radiating element 2: −90°, radiating element 3: −180° and radiating element 4: −270°. The two sets of four dual inverted-L shaped conductive surfaces elements are the sole, and thus main, radiators or receivers The L shaped conductive surfaces can be in the form of an echelon. A ground plane may be included. Each inverted L shaped conductive surface has a leg and an arm bent with respect to each other. The leg extends away from the ground plane, e.g. at a shallow angle to the vertical or perpendicularly to the ground plane. This angle to the vertical can be between 30 and 0°, typically 10 to 15° with the slope being towards the perpendicular centre axis of the ground plane. The arm extends in a direction parallel or nearly parallel to the ground plane. The bend between the arm and leg can be a curve.

Each radiating element has at least two inverted L shaped conductive surfaces in a pair and can have four inverted L shaped surfaces or in other words two pairs. A pair of inverted L shaped conductive surfaces of one radiating element are in the same vertical plane (referred to the ground plane as horizontal) and are electromagnetically and galvanically coupled together.

The legs of each radiating element start from a position close to the edge of the ground plane—where it is connected to a feed network—and are bent inward towards the center of the ground plane to form the arms.

The present invention provides a first embodiment of the radiating element. It provides for coverage of all current and future frequency bands of GNSS and is shown in FIGS. 1 to 4.

The present invention also provides a second embodiment of the radiating element which provides for an individual connection to each of the two bands covered and is shown in FIGS. 8 to 11. This structure is also provides for greater design flexibility and can have an embedded diplexer.

In accordance with embodiments of the present invention a gap can be provided between both L-Shaped conductive surfaces in both structures. The gaps are optional and can be configured to optimize the performance.

With respect to any one or all embodiments of the present invention, the radiating element is mounted in an antenna structure. Optionally a part of the outside structure can be a cavity which makes the antenna a cavity backed antenna. In addition a smaller ring can be provided that may be considered a choke ring. Both of these structures contribute to the performance of the radiating element.

Antennas according to embodiments of the present invention have a gain for one of RHCP and LHCP radiation. In the examples the antenna is for use with RHCP radiation. The angle theta is 0° along a normal to the ground plane. The CP gain e.g. RHCP gain is high around the normal at 0° so that a hemispherical radiation is created.

Important advantages provided by this antenna performance are:

a) The realized gain of the not desired circular polarization, e.g. LHCP is lower than −10 dB over the complete sphere from −180° to +180°. The advantage is that the antenna has a higher gain for the desired circular polarization e.g. RHCP signals in the range +90 to −90° and rejects or has a low gain for the not desired circular polarization, e.g. LHCP signals.

b) From 0° to angles at low elevation angles (e.g. at 90° or −90°) the axial ratio is less than 6 dB and preferably less than 4 dB. The advantage is that the antenna has a gain for the desired circular polarization, e.g. RHCP signals and rejects the not desired circular polarization, e.g. LHCP signals.

c) The roll off from the peak of the desired circular polarization, e.g. RHCP gain at 0° to the desired circular polarization, e.g. RHCP gain at low elevation angles (e.g. at 90° or −90°) is less than 20 dB, preferably less than 15 dB. The advantage is that the radiation pattern is hemispherical with gains not only at 0° but also at low elevations i.e. at 90° or −90°.

DETAILED DESCRIPTION OF THE INVENTION

The present invention relates to a transmit and/or receive antenna with substantially hemispherical radiation pattern. Such an antenna can handle, for example, circularly polarized (CP) electromagnetic waves, i.e. Left Hand Circularly Polarised (LHCP) or Right Hand Circularly Polarised (RHCP) electromagnetic waves. The antenna can be designed to reject either right handed or left handed circularly polarised electromagnetic waves. The embodiments below will be described with reference to antennas designed for Right Hand Circularly Polarised (RHCP) electromagnetic waves. The selection of Right Hand Circularly Polarised (RHCP) electromagnetic waves or Left Hand Circularly Polarised (RHCP) electromagnetic waves is dependent upon how the radiating elements are fed. The structure of the antenna is the same in both cases.

Figure 1:
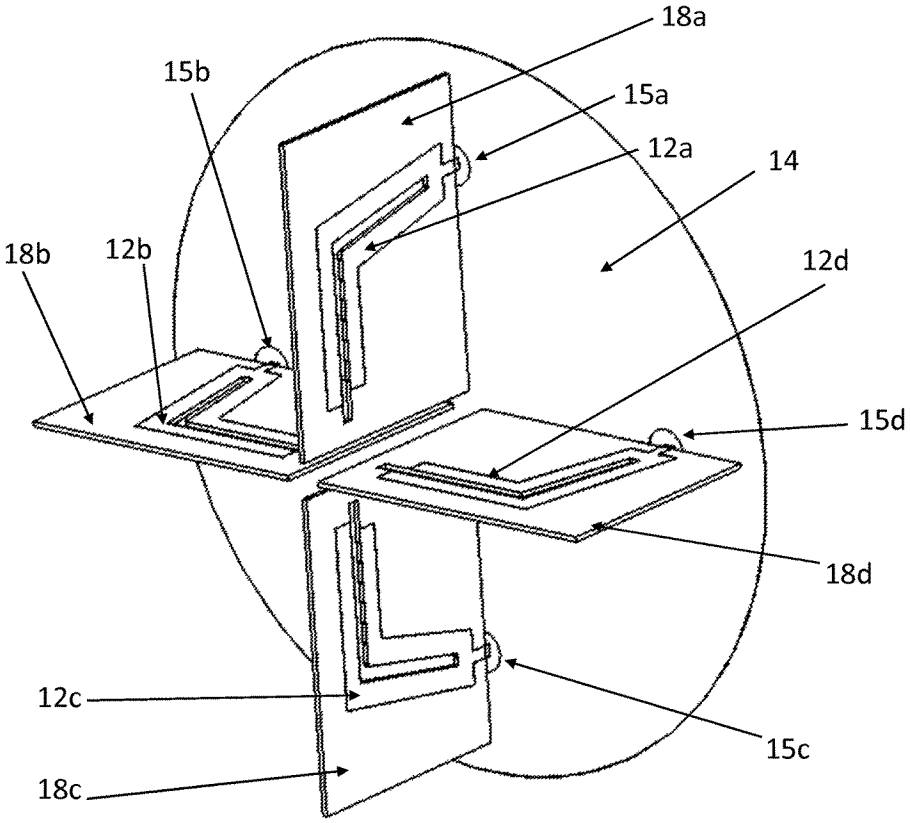
FIG. 1: Perspective view of an antenna according to an embodiment of the present invention.
Figure 2:
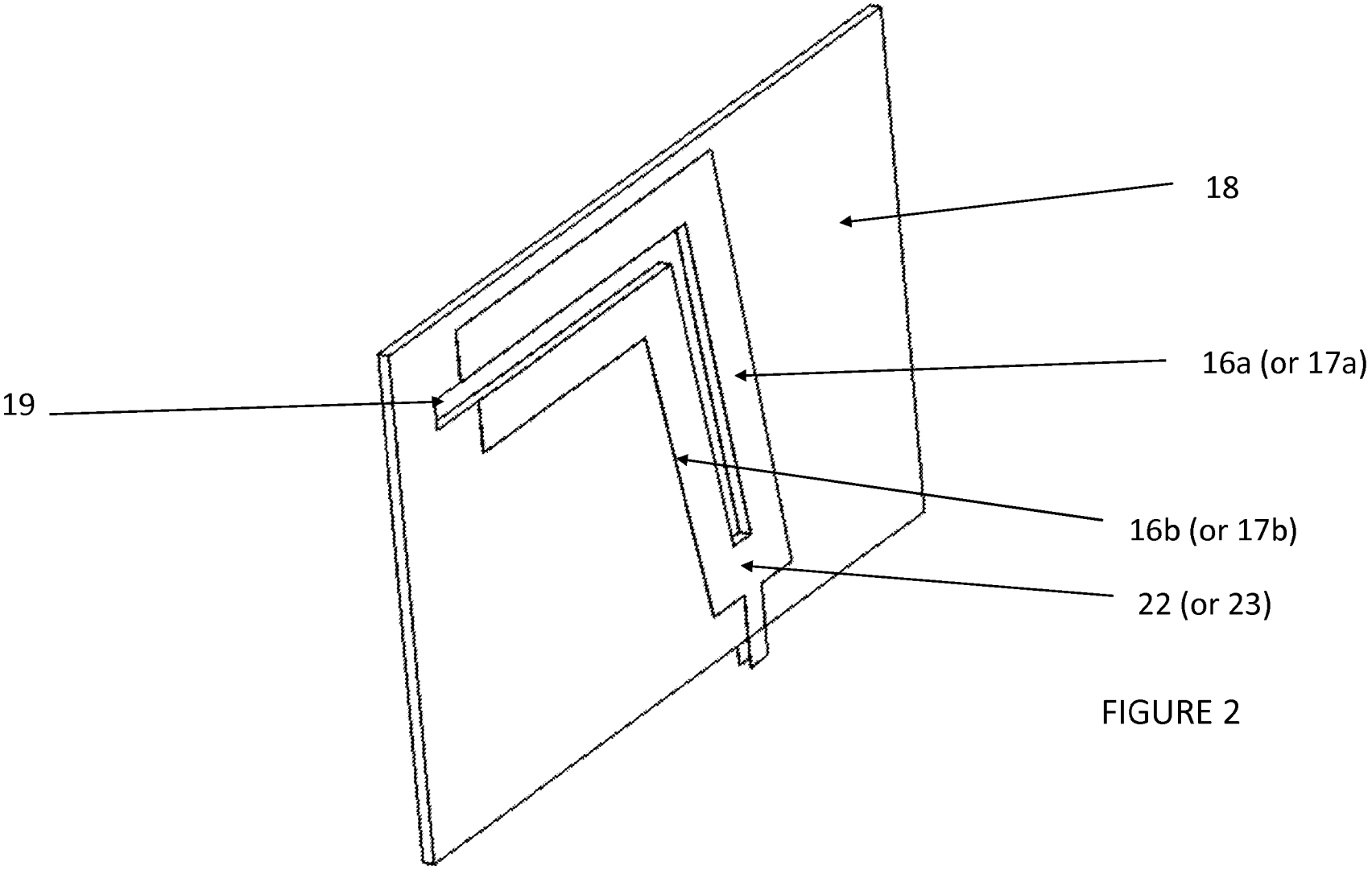
FIG. 2: radiating element for use with embodiments of the present invention.

FIG. 1 is a 3D schematic view of an embodiment of an antenna and FIG. 2 shows a detail of a radiating element 12. FIGS. 1 and 2 show an antenna 10 and 12, respectively, comprising array of 4 identical radiating elements 12*a* to *d* mounted above a ground plane 14. The ground plane 14 is preferably flat under the array of radiating elements 12*a* to *d*. The radiating elements 12*a* to *d* are the main radiating parts of the antenna 10. Each radiating element 12*a* to *d* of this embodiment comprises or consists of at least 2 inverted L-shaped, electrically conducting surfaces 16*a, b* which are formed, e.g. etched or mounted in or on one side of a suitable substrate 18 such as an insulating substrate, e.g. a PCB (e.g. FR-4). As there are four radiating elements 12*a* to *d*, there are four substrates 18 to *d*. The four substrates 18*a* to *d* extend away from the ground plane 14, i.e. are perpendicularly thereto and also extend out radially from the center of the ground plane 14. The substrates 18*a* to *d* are spaced at 90° to each other. The inverted L shaped electrically conducting surfaces 16*a*, 16*b* of each radiating element 12 are in the form of an echelon. This means that the conducting surfaces 16*a* and 16 are arranged one above the other so that they lie vertically in the same plane, i.e. perpendicularly to the ground plane. The inverted L shaped electrically conducting surfaces 16*a*, can be upper or outer conducting surfaces, whereas the inverted L shaped electrically conducting surfaces 16*b*, can be inner or lower conducting surfaces. The inverted L shaped electrically conducting surfaces 16*a* are in the same plane with respect to the inverted L shaped electrically conducting surfaces 16*b* with a gap therebetween. There can be a slot 19 in the substrate 18*b* which is aligned with the gap between the inverted L shaped electrically conducting surfaces 16*a* and *b*.

Thus in this embodiment there are 4 identical radiating elements 12*a* to *d*, each radiating element 12*a* to *d*, being mounted in or on one side of an insulating substrate 18*a* to *d*, respectively whereby a pair of inverted L shaped electrically conducting surfaces 16*a* or 16*b* form one radiating element and are associated one of the substrates 18*a* to *d*, e.g. with one side of the substrate 18*a* to *d*. Hence in total there are 4 pairs of surfaces 16*a* and *b* on the four substrates 18*a* to *d*. In a further embodiment one further pair of inverted L shaped electrically conducting surfaces 17*a* and *b* is associated with each of the insulating substrates 18*a* to *d* but on the other side of the substrate compared with the side having inverted L shaped electrically conducting surfaces 16*a* and *b*. The inverted L shaped electrically conducting surfaces 17*a*, can be upper or outer conducting surfaces, whereas the inverted L shaped electrically conducting surfaces 17*b*, can be inner or lower conducting surfaces. Thus in this embodiment there are 4 identical radiating elements 12*a* to *d*, each radiating element 12*a* to *d* comprising four inverted L shaped electrically conducting surfaces 16*a* and *b* and 17*a* and *b*, pairs of surfaces 16*a, b* and 17*a, b* being mounted on opposite sides of each substrate 18 *a* to *d*, whereby two pairs of inverted L shaped electrically conducting surfaces 16*a* or 16*b* and 17*a* or *b* form one radiating element 12.

Each inverted L-shaped electrically conducting surface 16 or 17 comprises a leg extending away from the ground plane and an arm bent with respect to the leg so that it extends substantially parallel to the ground plane and directed towards the center of the ground plane. The bend between the arm and leg can be a curve. The leg may be at angle to the perpendicular from the ground plane, for example of between 0 and 30°, e.g. 10 to 15° with the slope being towards the perpendicular centre axis of the ground plane.

The inverted L-shaped electrically conducting surfaces 16*a*, 16*b* in the insulating substrate 18*a* to *d* or on the same side of an insulating substrate 18*a* to *d* such as a PCB are electrically and galvanically connected to each other (in this embodiment) by a connection 22 at the bottom of the legs at a location close to the ground plane 14. For the embodiment with additional inverted L shaped electrically conducting surfaces 17*a* and *b* these are also electrically and galvanically connected to each other at a connection 23 at the bottom of the legs close to the ground plane 14. These electrical connections 22, 23 in both embodiments extend through the ground plane 14, e.g. each through a hole 15 (i.e. 15*a* to *d* respectively) in ground plane 14 towards the back of the ground plane 14 so that the radiating elements 12 are not connected to the ground plane 14. In case the ground plane is a PCB the holes 15*a* to *d* only need to be in the copper layers. For the embodiment with additional inverted L shaped conducting surfaces 17*a* and *b*, the connections 22, 23 of the inverted L shaped conducting surfaces 16*a* and *b* and 17*a* and *b* on respective sides of the insulating substrate 18 such as a PCB are combined into one electrical connection. Hence for both of these embodiments the inverted L shaped conducting surfaces on one substrate 18 are connected together electrically and galvanically to form a single radiating element 12. The radiating elements 12 are not electrically connected to the ground plane 14.

The roughly horizontal arms of the radiating elements 12, i.e. the arms more or less parallel with the ground plane 14 and which form the ends of the radiating elements, are directed towards each other, i.e. towards the center or central axis of the antenna 10. This means that the bases of the legs of the radiating elements that pass through the ground plane through the holes 15 are located away from the center of the antenna 10, i.e. more towards the outer edge of the ground plane 14.

Some details about the radiating element 12 are shown in FIG. 2. The inverted L-Shaped surfaces 16 or 17 shown in FIG. 2 are made from a conductive material. In an embodiment, these surfaces are made from, e.g. in a suitable substrate such as a printed circuit board material which acts as an insulator with the inverted L-Shaped surfaces being made from a metal such as copper and these are formed on the insulating substrate such as a PCB substrate like FR4.

Between the inverted L-Shaped structures gaps are located, i.e. between each of the 2 arms of the two structures 16*a* and *b* or 17*a* and *b*. These gaps are optional but if they are present, they are beneficial for optimizing the antenna. A slot 19 can be formed in the insulating substrate 18 and the slot can be aligned with the gap between each of the 2 arms of the two structures 16*a* and *b* or 17*a* and *b*. As shown in FIG. 2, the surfaces 16*a* and *b* or 17*a* and *b* are connected electrically and galvanically to each other at connections 22 and 23 respectively.

Figure 3:
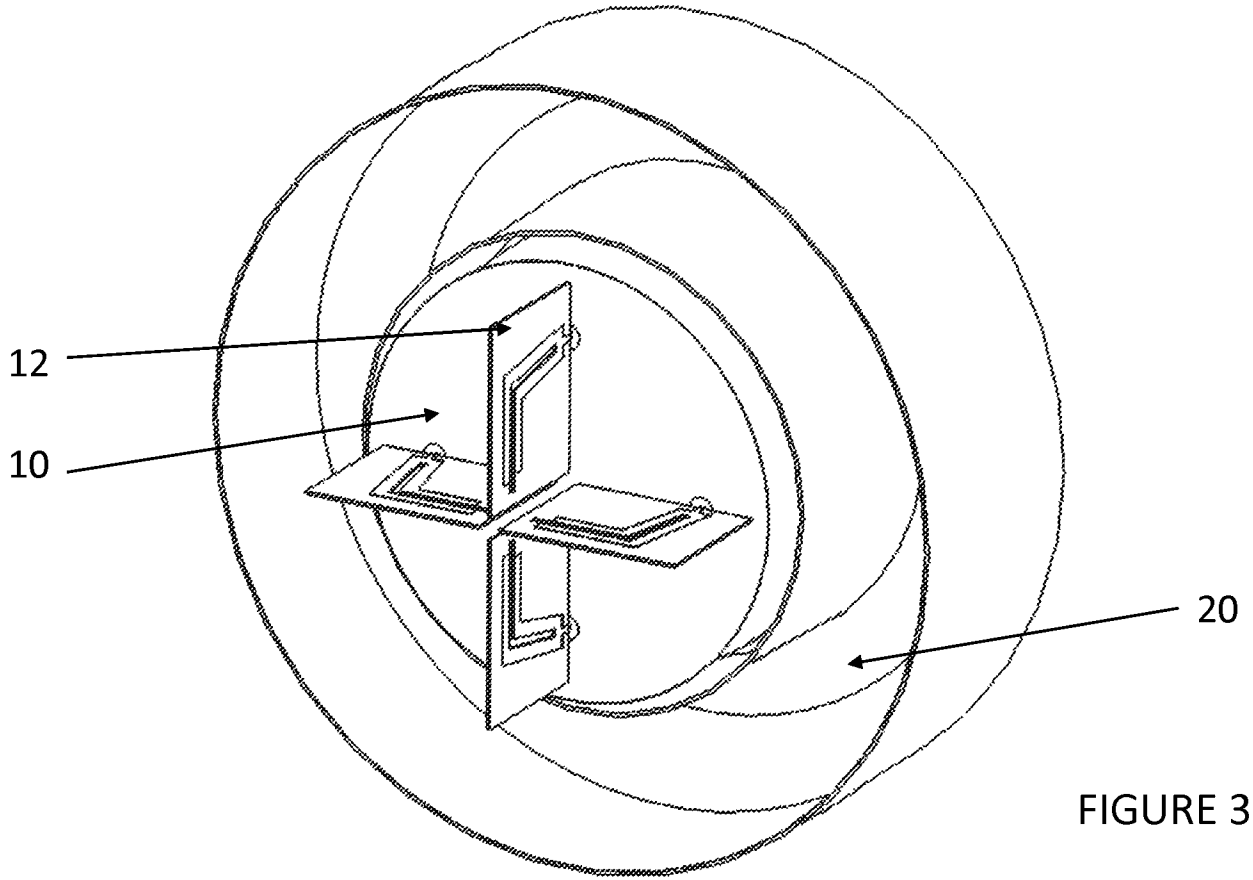
FIG. 3: Perspective view of an antenna according to another embodiment of the present invention.
Figure 4:
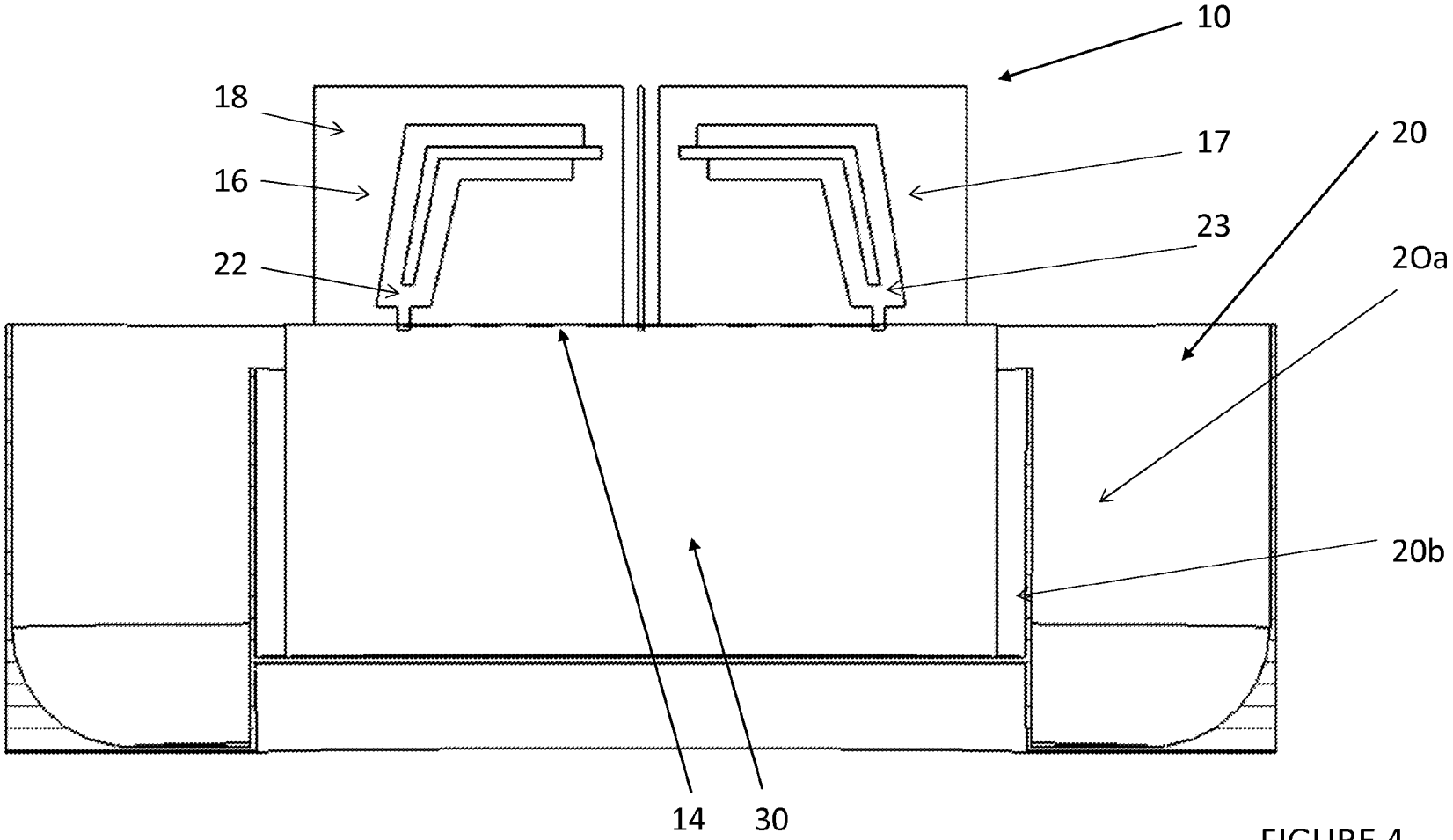
FIG. 4: Cross section view of a GNSS base station antenna according to an embodiment of the present invention.

FIGS. 3 and 4 show an antenna 10 with radiating elements exactly as described for FIG. 1 but with additional components. In this embodiment the ground plane 14 is also preferably flat under the array of radiating elements 12 and the antenna has a choke ring like shape 20 around, i.e. surrounding the flat region of the ground plane 14 and at its back. Under the array or radiating elements 12 a cavity 30 can be made at the back of the antenna under the array ground plane 14. There are preferably 2 choke rings 20, one narrower and shallower 20*b*, and one broader and deeper 20*a* (see FIG. 4). Both choke rings 20*a* and 20*b* surround the cavity 30 with ring 20*b* on the inside surrounding the cavity 30. The choke ring or choke rings 20, 20*a*, 20*b* are made of conductive material. The cavity 30 is where the feed network (not shown—see further) and any accompanying electronics (LNA, filters . . . ) are or can be located. Optionally, this antenna 10 can require a diplexer to split the signal coming from the feed network output into 2 frequency bands. The diplexer can also add desired filtering to suppress unwanted out of band interferers. Each frequency band has its own LNA. Diplexers are preferably not used. One way to avoid a diplexer is described with respect to the embodiment of FIGS. 8 to 11.

FIG. 4 shows a cross section of the antenna 10 as described with respect to FIG. 3. This is a clearer view of inverted L-shape of the 2 surfaces 16*a* and *b* or 17*a* and *b* creating a radiating element 12, the connection 22 (or 23) between the 2 inverted L-shaped conducting surfaces of a radiating element 12 and the extension of this connection 22 (or 23) to the back of the ground plane 14 (into cavity 30). Typical dimensions (not limiting can be: diameter of choke ring 20*a*, 214 mm, height of substrate 18 above ground plane 14, 35 mm, and depth of choke ring below the ground plane 14, 72 mm. The legs of the conducting surfaces 16 and/or 17 can have an angle to the perpendicular from the ground plane of between 30 and 0°, typically 10 to 15° with the slope being towards the perpendicular centre axis of the ground plane.

The net effect of the embodiments shown and described with reference to FIGS. 1 to 4 (and also as described later for FIGS. 8 to 11) is any or all of:

a good or an optimal hemispherical radiation and reception pattern with excellent low elevation axial ratio while maintaining a good front-to-back ratio. Good low elevation axial ratio and front to back ratio are needed to have good multipath suppression which is important for GNSS (GPS) antennas. Embodiments of the present invention have an advantage of compactness compared to a full scale classic choke ring, which is more expensive to make and larger.

Figure 5:
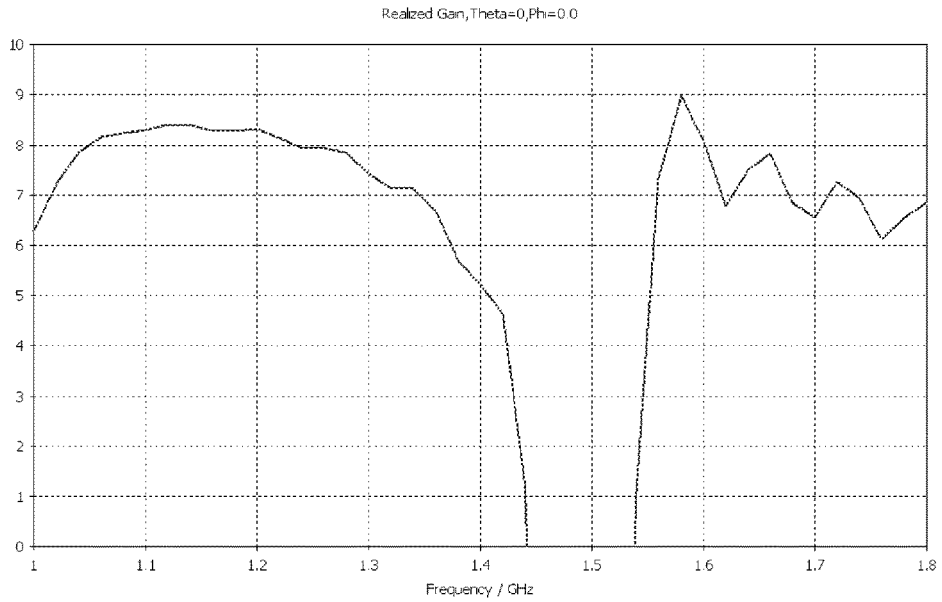
FIG. 5: Base station antenna according to an embodiment of the present invention showing simulated realized RHCP gain versus frequency.
Figure 6:
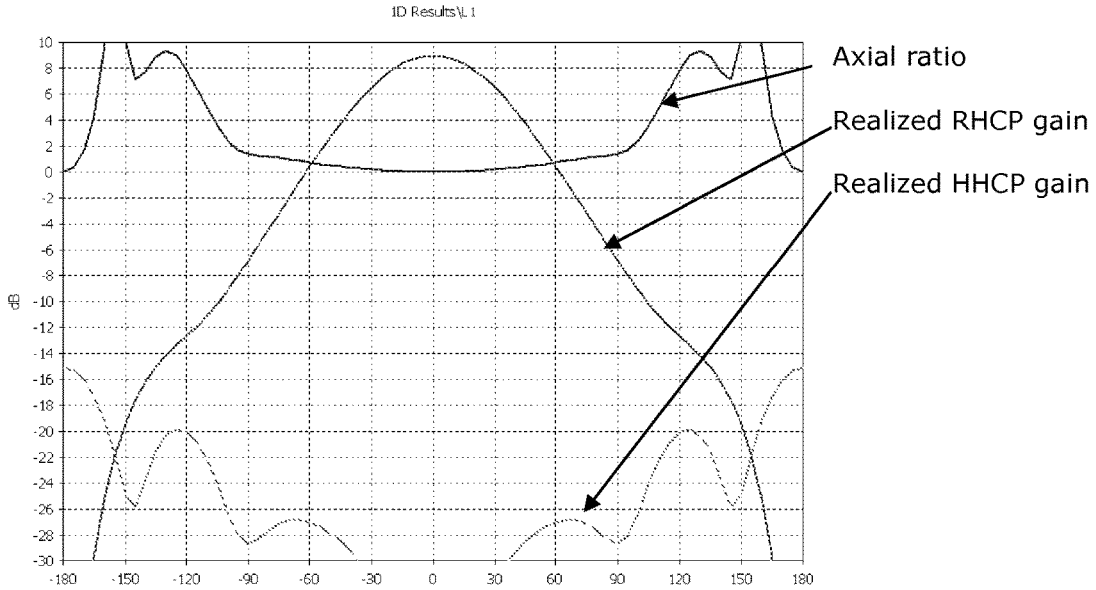
FIG. 6: Base station antenna according to an embodiment of the present invention showing simulated typical realized RHCP gain, realized LHCP gain and axial ratio versus theta at GPS L1.
Figure 7:
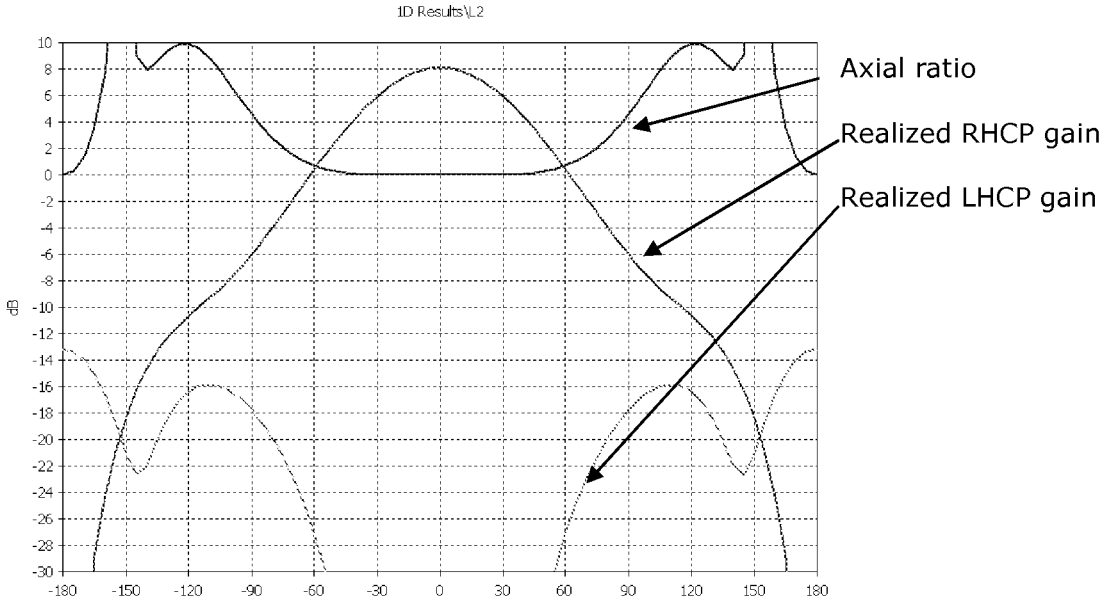
FIG. 7: Base station antenna showing simulated typical realized RHCP gain, realized LHCP gain and axial ratio versus theta at GPS L2

FIG. 5-7 show simulation results of an antenna according to embodiments of the present invention to demonstrate these advantages.

FIG. 5 shows the RHCP gain versus frequency and indicates that there are two frequency ranges in the GHz region in which the RHCP gain is high. These ranges are sufficient for the antenna to be used with satellite navigation systems such as GNSS positioning systems, GPS, Galileo, Compass etc.

FIGS. 6 and 7 show the RHCP and LHCP gain and, axial ratio versus the angle theta for the GPS L1, and GPS L2 frequencies respectively. The angle theta is 0° along a normal to the ground plane. The antenna is to operate with RHCP radiation. The RHCP performance as shown is for one plane but the RHCP gain is high at any rotation about the normal at 0° so that a hemispherical radiation is created.

Important advantages provided by this antenna performance are:

a) The realized gain of the not desired circular polarization, e.g. LHCP is lower than −10 dB over the complete sphere from −180° to +180°. The advantage is that the antenna has a higher gain for the desired circular polarization e.g. RHCP signals in the range +90 to −90° and rejects or has a low gain for the not desired circular polarization, e.g. LHCP signals.

b) From 0° to angles at low elevation angles (e.g. at 90° or −90°) the axial ratio is less than 6 dB and preferably less than 4 dB. The advantage is that the antenna has a gain for the desired circular polarization, e.g. RHCP signals and rejects the not desired circular polarization, e.g. LHCP signals.

c) The roll off from peak of the desired circular polarization, e.g. RHCP gain at 0° to the desired circular polarization, e.g. RHCP gain at low elevation angles (e.g. at 90° or −90°) is less than 20 dB, preferably less than 15 dB. The advantage is that the radiation pattern is hemispherical with gains not only at 0° but also at low elevations i.e. at 90° or −90°.

Figure 8:
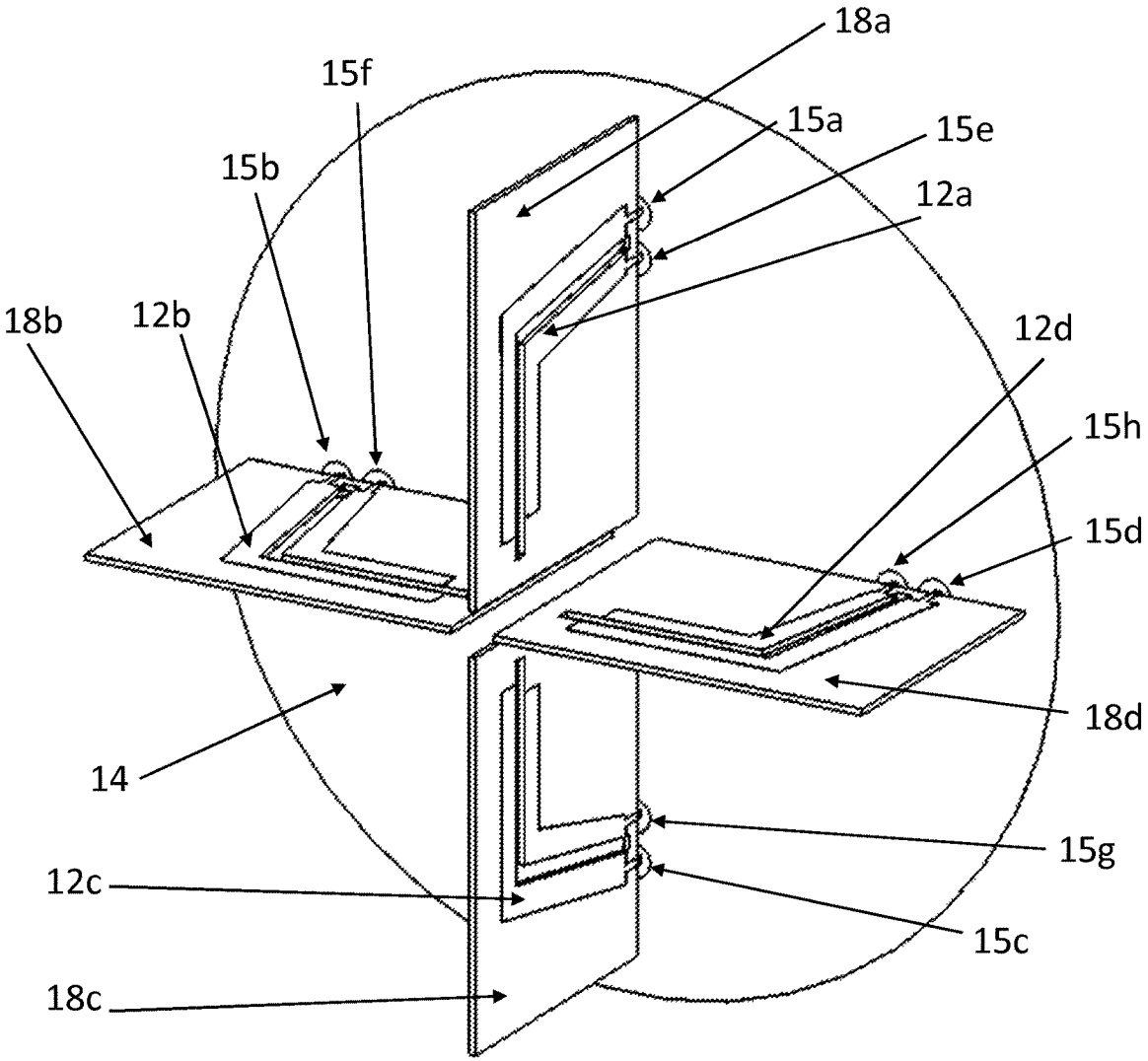
FIG. 8: Perspective view of an antenna according to another embodiment of the present invention.
Figure 9:
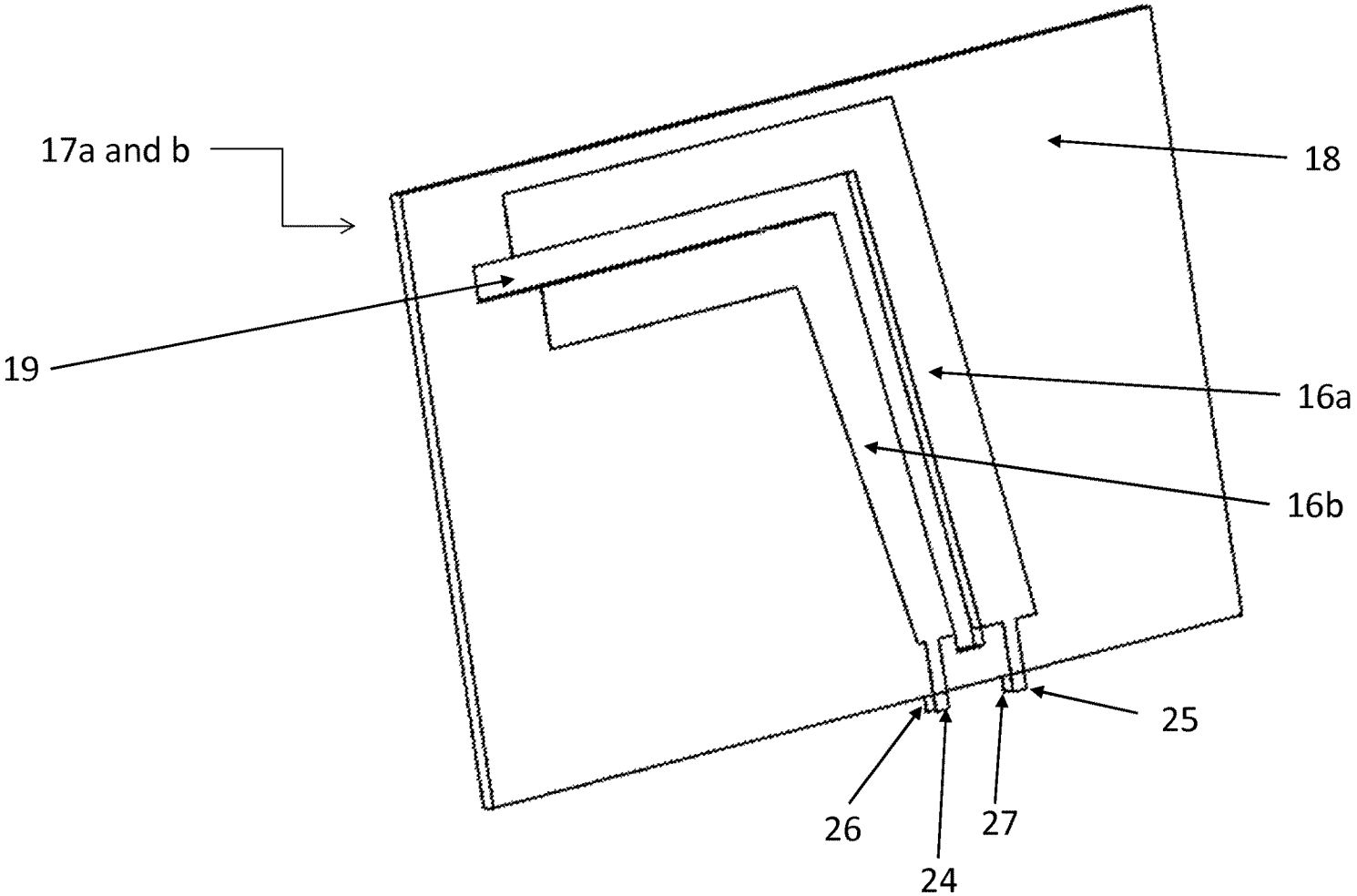
FIG. 9: radiating element for use with embodiments of the present invention.
Figure 10:
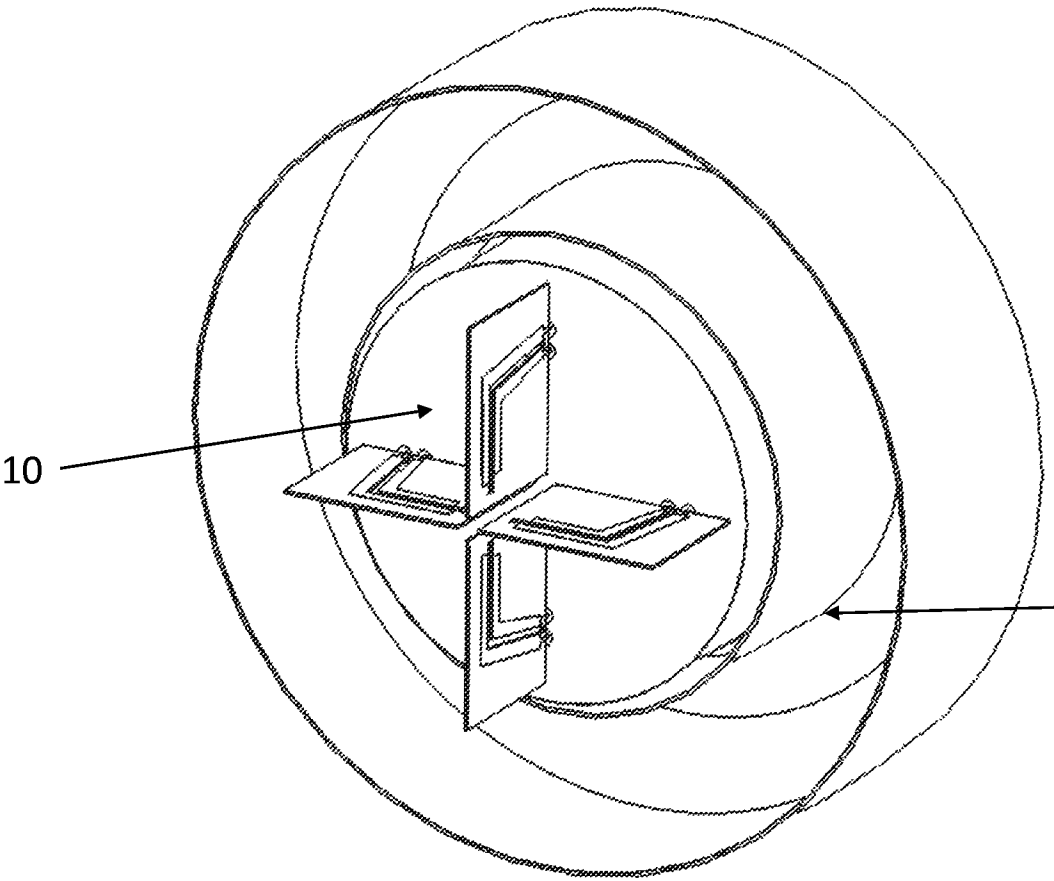
FIG. 10: Perspective view of an antenna according to another embodiment of the present invention.
Figure 11:
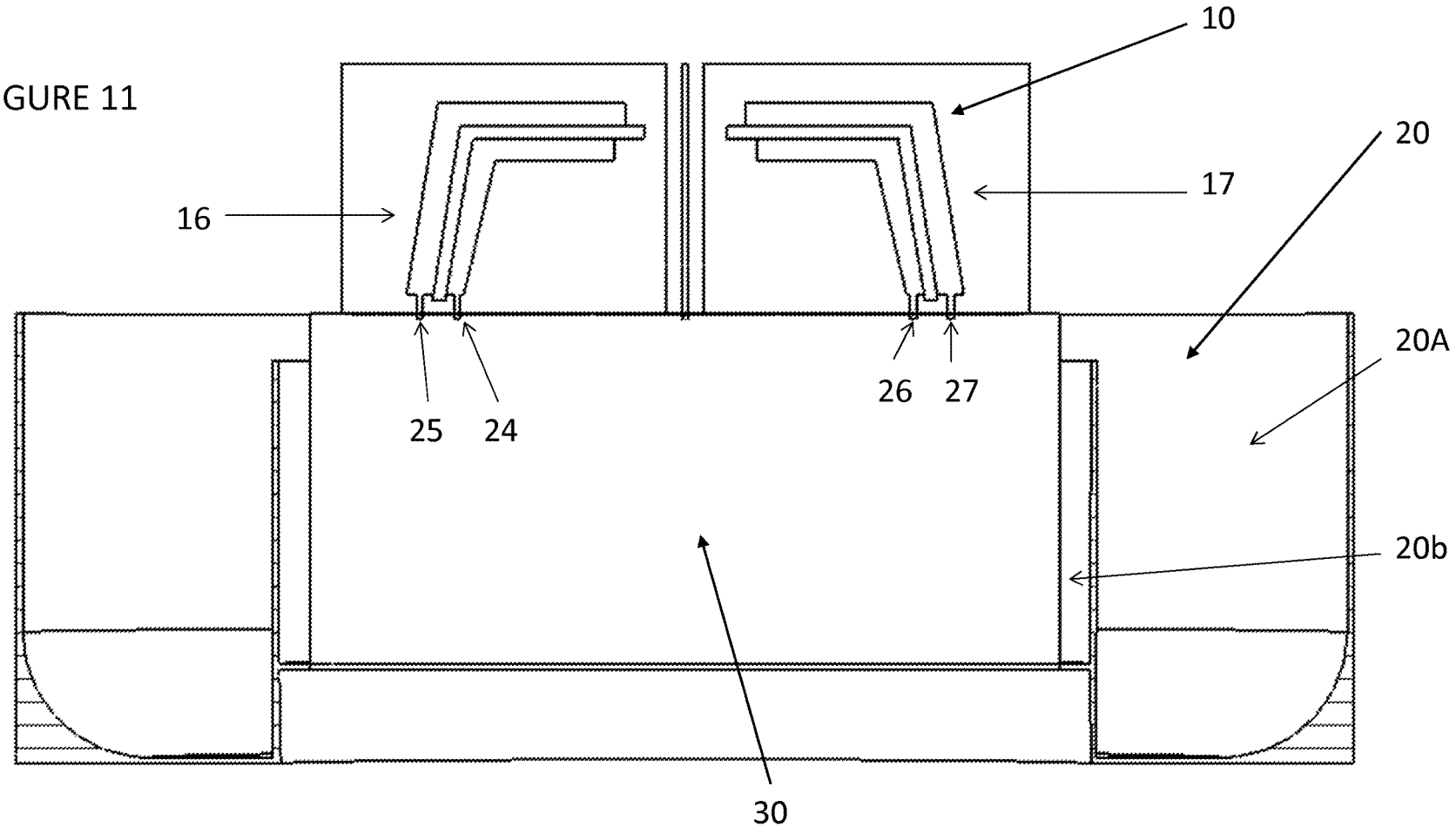
FIG. 11: Cross section view of a GNSS base station antenna according to an embodiment of the present invention.

A different embodiment of this antenna is shown in FIGS. 8 to 11. FIG. 8 is a 3D view of an antenna 10 in accordance with this embodiment. FIG. 9 is a more detailed figure of radiating surfaces 16 or 17 and connections 24, 25, 26, 27. FIG. 10 shows the antenna of FIG. 8 with the addition of one or more choke rings 20*a* and/or *b*. FIG. 11 shows a cross-section through the antenna of FIG. 10. The details, components and arrangements of this embodiment are identical to all that has been described with respect to FIGS. 1 to 4 with the following exceptions.

In this embodiment each of the two legs that make up each of the 4 dual inverted-L shaped conducting surfaces respectively either 16*a* or *b* or respectively 17*a* or *b* is connected through respective connections 25, 24; 27, 26 instead of a single connection 22 and 23 and fed individually through the ground plane 14 through two sets of holes 15*a* to *h*. This embodiment of the radiating elements 12 comprise 2 sets of a sequentially rotated array of 4 single inverted-L conducting surfaces 16*a* (and optionally 17*a*) and a sequentially rotated array of 4 single inverted-L conducting surfaces 16*b* (and optionally 17*b*). In FIGS. 8 to 11 the same elements are present as in FIGS. 1 to 4, e.g. radiating element 12, ground plane 14, surfaces 16*a* and 16*b*, optionally surfaces 17*a* and *b*, insulating substrates 18*a* to *d* such as a PCB, choke ring or rings 20, optionally 20*a*, and/or 20*b* except where stated differently in this text, especially how the radiating elements are constructed and connected.

In this configuration, each of the sets of 4 individual radiating elements 12, namely separately 16*a* (and optionally 17*a*) and 16*b* (and optionally 17*b*) is fed with the same magnitude and a 90° sequential phase difference for the purpose of creating right or left hand circular polarization. The legs of the conducting surfaces 16 and/or 17 can have an angle to the perpendicular from the ground plane of between 30 and 0°, typically 10 to 15° with the slope being towards the perpendicular centre axis of the ground plane.

This embodiment allows for a separate connection 24, 25 (and optionally 26, 27) to be supplied with or receiving each of the two frequency bands covered by the antenna 10. Hence individual radiating surfaces 16*a* to *d* or 17*a* to *d* can each be supplied with one of the two frequency bands covered by the antenna 10. This, in turn, provides for an improved flexibility and cost saving of low noise amplifiers connected to the antenna since the antenna now has an embedded diplexer.

The embodiments of FIGS. 8 to 11 differ from the antenna previously described with respect to FIGS. 1 to 4 by the absence of the electrical connection 22 or 23 between the 2 inverted L-shaped conducting surfaces (16*a* and *b*, or 17*a* and *b* respectively) on the same side of the insulating substrate 18 such as a PCB. In these embodiments each inverted L-shaped conducting surface 16*a*, 16*b*, optionally 17*a*, 17*b* of a radiating element 12 extend separately towards and through the back of the ground plane 14. This leads to each radiating element 12 comprising 2 radiating subelements. Thus, in these embodiments there are 2 arrays of 4 radiating elements, namely an inner array comprising the 4 inverted L-shaped conductive surfaces 16*b* or 17*b* closest to the center of the antenna, and an outer array comprising the 4 inverted L-shaped conductive surface 16*a* or 17*a* furthest away from the ground plane of the antenna. There is some degree of isolation between the 2 arrays eliminating the need for a diplexer.

In all embodiments described above each array has its own feed network. This effectively creates the functionality of a diplexer. A similar filtering (diplexing) performance can be achieved for the embodiment described with reference to FIGS. 8 to 11 compared to the antenna described of FIGS. 1 to 4 without the use of an expensive diplexer, but at the added cost of a second feed network. The antenna of FIGS. 8 to 11 should still be more economical than the antenna of FIGS. 1 to 4.

The feed network for use with any of the embodiments described with reference to FIGS. 1 to 4 and 8 to 11 can optionally be as described in US20120299789A1 which describes a circularly polarized antenna and feeding network but the present invention is not limited thereto. In particular, in order to generate circular polarized electromagnetic radiation with said antenna, the radiating and/or receiving elements are fed with an appropriate signal. The input signal must be distributed to each radiating and/or receiving element, such that the radiating and/or receiving elements are excited with signals having a sequential 90° [deg.] phase difference in relation to each other. Additionally, the feeding network is preferably adapted to provide these exciting signals across a large bandwidth in order to take advantage of the bandwidth of the antenna. It is to be understood that even if the description mainly refers to transmit, the feeding network can be used in receive or in transmit.

The feed network operates as an electrical coupler between the radiating or receiving antenna elements of an antenna and external electronics.

A 90° coupler is a device that is used to equally split an input signal into two output signals with a resultant 90° phase difference between output signals. This coupler may be described as a differential phase splitter. A 180° coupler is a device that is used to equally split an input signal into two output signals with a resultant 180° phase difference between output signals. This coupler may be described as a differential phase splitter.

An embodiment of a feeding network is as described in US20120299789A1 in particular as described with respect to FIG. 3 and FIG. 4 of that application which are incorporated by reference. Such a feeding network may be used for receiving signals from or feeding signals to the radiating and/or receiving elements of the antenna according to the present invention. The feeding network when used in transmit mode can have a single input for receiving a signal, which is to be transmitted by the antenna, and four outputs are provided for feeding to the antenna elements. Each of these outputs is connected to one radiating and/or receiving element via a feed probe. If a monochromatic signal is input to said electrical coupler, then the four outputs each carry a signal with identical amplitude and the same frequency as the input signal. The four output signals are sequentially phase shifted by 90°. The resulting phase shift can be achieved by using two distinct phase shifters. A 180° coupler can be arranged at two of the outputs. These signals are phase shifted by 180°. The next stage of the electrical coupler comprises two identical 90° couplers, which are connected to the two outputs of the 180° coupler, respectively. Both 90° couplers divide the input signal into two equally strong signals with a 90° phase difference between them. Consequently, the four output signals from the two 90° couplers are each phase shifted by 90°, 180° or 270° with respect to each other.

FIG. 4 of US20120299789A1 which is incorporated by reference shows a further implementation of feeding network for use in the present invention, i.e. with any of the embodiments described with reference to FIGS. 1 to 4 and/or FIGS. 8 to 11.

The structure of FIG. 4 of US20120299789A1 is basically created by exchanging the 180° coupler of FIG. 3 of US20120299789A1 with a 90° coupler and replacing the 90° couplers of FIG. 3 of US20120299789A1 with 180° couplers. Otherwise the overall structure is identical. The 90° coupler generates two identical output signals, which are phase shifted by 90°. The signals on outputs are merely exchanged in comparison with the embodiment of FIG. 3 of US20120299789A1.

The 90° coupler may be implemented by a quadrature coupler such as a branchline coupler also known as quadrature hybrid. For example, the branchline coupler may comprise four quarter wavelength transmission lines, which are connected to each other as to form a ring of transmission lines. A signal entering a port is split into two quadrature signals at further two ports, with the remaining port well isolated from the input port within the operating frequency band. This arrangement yields an appropriate 90° phase difference across a reasonably wide frequency band. However, both circuits of FIGS. 3 and 4 of US20120299789A1 additionally comprise a 180° coupler. Conventional 180° couplers do not provide a precise 180° phase difference across a reasonably wide frequency band. This is true in particular for rat race couplers.

Consequently, a novel 180° coupler is shown in FIG. 5 of US20120299789A1 which is incorporated by reference. This 180° coupler may be used in the coupling circuits of FIGS. 3 and 4 of US20120299789A1. The 180° coupler of FIG. 5 of US20120299789A1 comprises an input and two outputs. The input signal is fed to a power splitter. The power splitter outputs two identical signals with the same magnitude, frequency and phase. The amplitude of the output signal of the power splitter is half the amplitude of its input signal. Additionally, the 180° coupler of FIG. 5 of US2012/0299789A1 comprises two essentially identical 90° couplers These 90° couplers are quadrature hybrids. The quadrature hybrids differ only in that one quadrature hybrid is adapted to shift the input signal by +90°, whereas the other quadrature hybrid is adapted to shift the input signal by −90°. For example, two quadrature hybrids can be identical and the impedance used to terminate them may be different. For example one hybrid can be loaded with inductors while the other is loaded with capacitors. This results in turn in two output signals, with a 180° phase difference. The one quadrature hybrid has a certain phase versus frequency variation (dispersion). A constant 180° phase difference between the 2 outputs is desired, thus equal dispersion. This means that each output of needs a phase shifter, e.g. one phase shifter consists of one hybrid and 2 inductors, the other phase shifter consists of the other hybrid and 2 capacitors.

In order to have a 180° phase difference the two reactive loads of the 2 quadrature hybrids need to be opposite in phase. Shorting or leaving the reflected outputs open is a possible implementation, but does not work very well because of an impedance mismatch and the hybrids cannot be tuned to compensate for this impedance mismatch. One quadrature hybrid is connected to two inductive loads, whereas the other quadrature hybrid is connected to two capacitive loads. Therefore, the output phase of the respective quadrature hybrids have a 180° phase difference. The magnitude of the impedance of the capacitive load is equal to the magnitude of the impedance of the inductive load and the phase of the impedance of the capacitive load is opposite to the phase of the impedance of the inductive load. The best wideband implementation is based on lumped element reactive loads because of their frequency less variant behaviour. In analogy with the short/open, one phase shifter needs capacitors while the other one needs inductors at the outputs. Reflection occurs at the inductors and capacitors. This results in the correct phase behaviour over the entire hybrid bandwidth.

To provide a 180° splitter a first device for phase shifting one of the two output signals from the power splitter and a second device for phase shifting the other of the two output signals from the power splitter can be provided whereby the total phase difference between the one output signal and the other output signal is 180°. Hence it is not necessary to always have exactly plus or minus 90° phase shift on the outputs provided the difference is 180°.

What is claimed is:

1. An antenna for receiving and/or transmitting electromagnetic radiation, comprising:

four radiating elements in the form of a sequentially rotated array of four dual inverted-L-shaped conductive surfaces extending away from a ground plane, each inverted-L-shaped surface comprising a leg and an arm, the legs extending away from the ground plane and having a bend to form the arms which extend substantially parallel to the ground plane towards the center of the ground plane, the leg and arm of each inverted-L-shaped surface lying in the same plane which extends away from the ground plane, each dual inverted L-shaped surface comprises two legs and two arms, and for each dual inverted L-shaped surfaces, one inverted L shaped electrically conducting surface being the upper or outer conducting surface, whereas the other inverted L-shaped electrically conducting surface is the inner or lower conducting surface, the arms of each dual inverted L-shaped surface being separated by a gap, wherein the antenna is configured to receive and/or transmit circularly polarized waves, and wherein the legs extend away from the ground plane at an angle to vertical of between 0 and 30°.

2. The antenna of claim 1 wherein the legs of each inverted-L-shaped surface are connected together galvanically.

3. The antenna of claim 1 wherein the legs of each inverted-L-shaped surface of the dual inverted L-shape surface are connected together galvanically.

4. The antenna of claim 1 further comprising a feeding network adapted to provide for each individual radiating element a signal of the same magnitude but with a 90° sequential phase difference for the purpose of creating right or left hand circular polarization.

5. The antenna of claim 1 further comprising a choke ring.

6. The antenna of claim 5, further comprising a dual choke ring structure on which the sequentially rotated array is mounted.

7. The antenna of claim 6, wherein the choke ring or the dual choke ring structure serves as housing/shielding of accompanying electronics.

8. The antenna of claim 7 wherein the electronics comprises low noise amplifiers and/or power conditioning.

9. The antenna of claim 1 wherein a plurality of L elements are in the form of an echelon.

10. The antenna claim 1 wherein the antenna is a cavity backed antenna.

11. The antenna of claim 10, wherein the cavity backed antenna is formed by mounting the sequentially rotated array on a structure that forms a cavity.

12. The antenna of claim 1 wherein the leg and arm of each inverted-L-shaped surface is on an insulating substrate.

13. The antenna of claim 1 comprising eight radiating elements in the form of two sequentially rotated arrays each of 4 inverted-L-shaped surfaces extending away from a ground plane, each sequentially rotated array being for transmitting or receiving one of two frequency bands.

14. The antenna of claim 1, wherein a realized gain of a not desired circular polarization is lower than −10 dB over a complete sphere from of −180° to +180° with respect to a normal from the ground plane.

15. The antenna of claim 1 wherein for elevation angles from 0° to 90° or 0° to −90° with respect to a normal from the ground plane, the axial ratio is less than 6 dB and preferably less than 4 dB.

16. The antenna of claim 1 wherein a roll off from a peak of a desired circular polarization, at 0° with respect to a normal from the ground plane to the desired circular polarization gain at 90° or −90° is less than 20 dB, preferably less than 15 dB.

17. A base station antenna including the antenna of claim 1.

* * * * *